United States Patent [19]

Wood et al.

[11] Patent Number: 4,987,543

[45] Date of Patent: Jan. 22, 1991

[54] WHEEL SPIN CONTROL SYSTEM

[75] Inventors: James A. Wood, Spartanburg; Richard J. Mazur, Greer, both of S.C.

[73] Assignee: American Standard Inc., Spartanburg, S.C.

[21] Appl. No.: 312,837

[22] Filed: Feb. 21, 1989

[51] Int. Cl.[5] ..... B60T 8/00

[52] U.S. Cl. ..... 364/426.03; 180/197

[58] Field of Search ..... 364/426.02, 426.03; 180/197; 361/238; 303/100, 103, 95

[56] References Cited

U.S. PATENT DOCUMENTS

| | | | |
|---|---|---|---|
| 3,482,887 | 12/1969 | Sheppard | 303/106 |
| 4,298,940 | 11/1981 | Tadokoro et al. | 364/426.03 |
| 4,410,947 | 10/1983 | Strong et al. | 364/426.03 |
| 4,486,839 | 12/1984 | Mazur et al. | 364/426.02 |
| 4,491,920 | 1/1985 | Wood et al. | 303/103 |
| 4,598,953 | 7/1986 | Wood et al. | 303/100 |
| 4,671,576 | 6/1987 | Fourie | 303/101 |
| 4,745,552 | 5/1988 | Phelps et al. | 364/426.03 |
| 4,819,168 | 4/1989 | Laskey | 364/426.03 |

*Primary Examiner*—Gary Chin

*Attorney, Agent, or Firm*—J. B. Sotak

[57] ABSTRACT

An energy storage wheel spin propulsion control system for detecting and correcting a spinning wheel situation so that the maximum available adhesion is utilized to the fullest extent in accelerating a railway vehicle while at the same time maximizing the use of the available processing time to permit an appropriate amount of time for diagnostic purposes. The primary data used to form the logic inputs is derived from the axle rate signals which are fed to spin energy storage value threshold and difference comparison sensors. The spin energy storage value and difference comparison sensors supply logical inputs in spin energy threshold, dissipation threshold and optimization threshold sensors and spin rate difference sum sensor, respectively, which, in turn, supply logic inputs to spin enable timer and spin enable sensors and a spin control logic output sensor. A slip-spin output determination sensor receives logic signals from a power-brake signal circuit and command signal from the spin control logic outer sensor and a slip interface circuit to cause the production of a full requested, reduce and/or hold tractive effort command.

15 Claims, 2 Drawing Sheets

WHEEL SPIN CONTROL SYSTEM

FIELD OF THE INVENTION

This invention relates to an energy storage wheel spin propulsion control procedure for accelerating vehicles in mass and/or rapid transit systems and more particularly to an electronic control system for detecting and correcting wheel spin so that maximum available adhesion is utilized during the acceleration of powered vehicles in high speed transit and/or railway operations.

BACKGROUND OF THE INVENTION

In certain types of transportation systems, such as, in state-of-the-art high speed railway and/or mass and rapid transit operations, it is advantageous to provide improved wheel spin detection and correction equipment so that passengers will not experience a noisy uncomfortable rough ride and so that wear and shelling occurs on the tread of the wheels which can lead to subsequent damage to bearings, truck, motors and lading are avoided. The definition of wheel spin refers to the acceleration of a vehicle wheel at a rate exceeding that corresponding to the rate of acceleration of the vehicle caused by excessive propulsion force or tractive effort to the wheel or loss of wheel-to-rail adhesion during the application of normal propulsion power. In railroad operations, the term adhesion means the coefficient friction between the wheel and rail. In a propulsion mode, adhesion is established by applying tractive force to the wheel and finding the force at which spinning occurs under various wheel, rail, track, climatic and equipment conditions. In practice, the typical adhesion values with steel wheels and steel rails range from about 7% to 25% depending upon speed, type of track and wheel conditions. It will be appreciated that the contact area between a rigid steel wheel and the steel rail is small, ranging from about one-third ($\frac{1}{3}$) to three-quarters ($\frac{3}{4}$) of a square inch depending upon the wheel size, the contour of the wheel thread and rail head and the weight on the wheel. It will be apparent that when a wheel spins the adhesion is less than when the wheel is normally rotating and rolling on the rail. As previously noted, a spinning rotation condition can cause severe wheel and rail damage. Previously, locomotives and modern multiple unit passenger trains were normally equipped with a conventional traction or power wheel spin detection and correction system. These prior systems generally detected if the speed of an axle is going faster than the train speed so that a power cutback will allow the wheels to slow down to the train speed. Thereafter, the propulsion power is automatically reapplied at a controlled rate to the degree called for by the position of the throttle. In previous wheel slip spin systems, it was necessary to perform a wheel size calibration or normalization procedure before proper operation could be achieved which is time consuming and requires additional processing functions. This precludes the diagnostic testing since there is not enough of available processing time.

OBJECTS AND SUMMARY OF THE INVENTION

Accordingly, it is an object of this invention to provide a new and improved electronic wheel spin control system for railway vehicles.

Another object of this invention is to provide a unique energy storage wheel spin propulsion control system for detecting and connecting a spinning condition when a wheel is rotating on its axis but motion exists between the wheel and rail at the area of contact.

A further object of this invention is to provide a novel railway vehicle wheel slip and/or spin control system for sensing the loss of wheel-to-rail adhesion and for initiating a corrective action to cause the speed of the wheel to return to the speed of the railway vehicle.

Yet another object of this invention is to provide an improved electronic energy wheel spin detecting and correcting control procedure for modern railway and/or mass and rapid transit operations.

Yet a further object of this invention is to provide a wheel spin control arrangement for detecting and correcting a spinning wheel situation so that the maximum available adhesion is used to the fullest advantage in accelerating a vehicle along its route of travel.

Still another object of this invention is to provide a vehicular wheel spin control system for sensing a wheel spinning condition and for restoring the speed of the spinning wheel to the speed of the moving vehicle without the need of using wheel size calibration or normalization.

In accordance with the present invention there is provided an energy storage wheel spin propulsion control system for detecting and correcting wheel spin during a power traction mode of a vehicle comprising, spin energy storage value means responsive to axle rate signal of each axle for producing logical output signal, spin energy storage sum means for causing a summing, subtracting and resetting of the logical output signal, first spin threshold means for producing a first logic signal when the axle rate signal of either axle is $\geqq$ a first predetermined axle rate, spin energy threshold means for producing a first logic signal when the logical output signal of said spin energy storage sum means is $\geqq$ a first logical output signal, spin rate difference comparison means for comparing the axle rate signal of each axle so that if the difference of the axle rate signal of the axles is greater than a second predetermined axle rate and the axle rate signal of one of the axles is greater than a third predetermined axle rate a first logic signal is produced and if not a second logic signal is produced, spin rate difference sum means for summing the first logic signal and the second logic signal of said spin rate difference comparison means, spin rate difference final output means for producing a first logic signal if the total of the first logic signal of said spin rate difference sum means is equal to a given value, second spin threshold means for producing a first logic signal when the axle rate signal of either axle is $\leqq$ a fourth predetermined axle rate, third spin threshold means for producing a first logic signal when the axle rate signal of either axle is $\leqq$ a fifth predetermined axle rate, spin energy dissipation threshold means for producing a first logic signal when the logical output signal of said spin energy storage sum means is $\leqq$ a second logical output signal, spin energy optimization threshold means for producing a first logic signal when the logical output signal of said spin energy storage sum means is $\leqq$ a third logical output signal, spin enable timer means responsive to a transition from a second logic signal to a first logic signal, said first spin threshold means, said spin energy threshold means, and said spin rate difference final output means for producing a first logic signal for a given time period and for producing a second logic signal upon expiration of the given time period and when a spin enable means undergoes a transition from a first logic signal to a second logic signal, said spin enable means receiving a first signal and a second logic signal from said spin enable timer means, said spin energy dissipation threshold means and said third spin threshold means for producing a first and a second logic signal, spin control logic output means responsive to a first logic signal and to a second logic signal received from said spin enable means, said second spin threshold means and said spin energy optimization threshold means for producing one of three spin control output signals, and slip-spin output determination means for receiving an input from a power brake signal means, a slip interface means and said spin control logic output means for producing a full, a reduce and/or a hold tractive effort output command signal.

DESCRIPTION OF THE DRAWINGS

The above objects and other attendant features and advantages will be more readily appreciated as the present invention becomes better understood by reference to the following detailed description when considered in conjunction with the accompanying drawings, wherein:

FIG. 1A is disposed on the left side and when FIG. 1B is disposed on the right side of an electronic vehicular energy storage wheel spin control system of the present invention.

DETAILED DESCRIPTION OF THE INVENTION

Figure 1A:
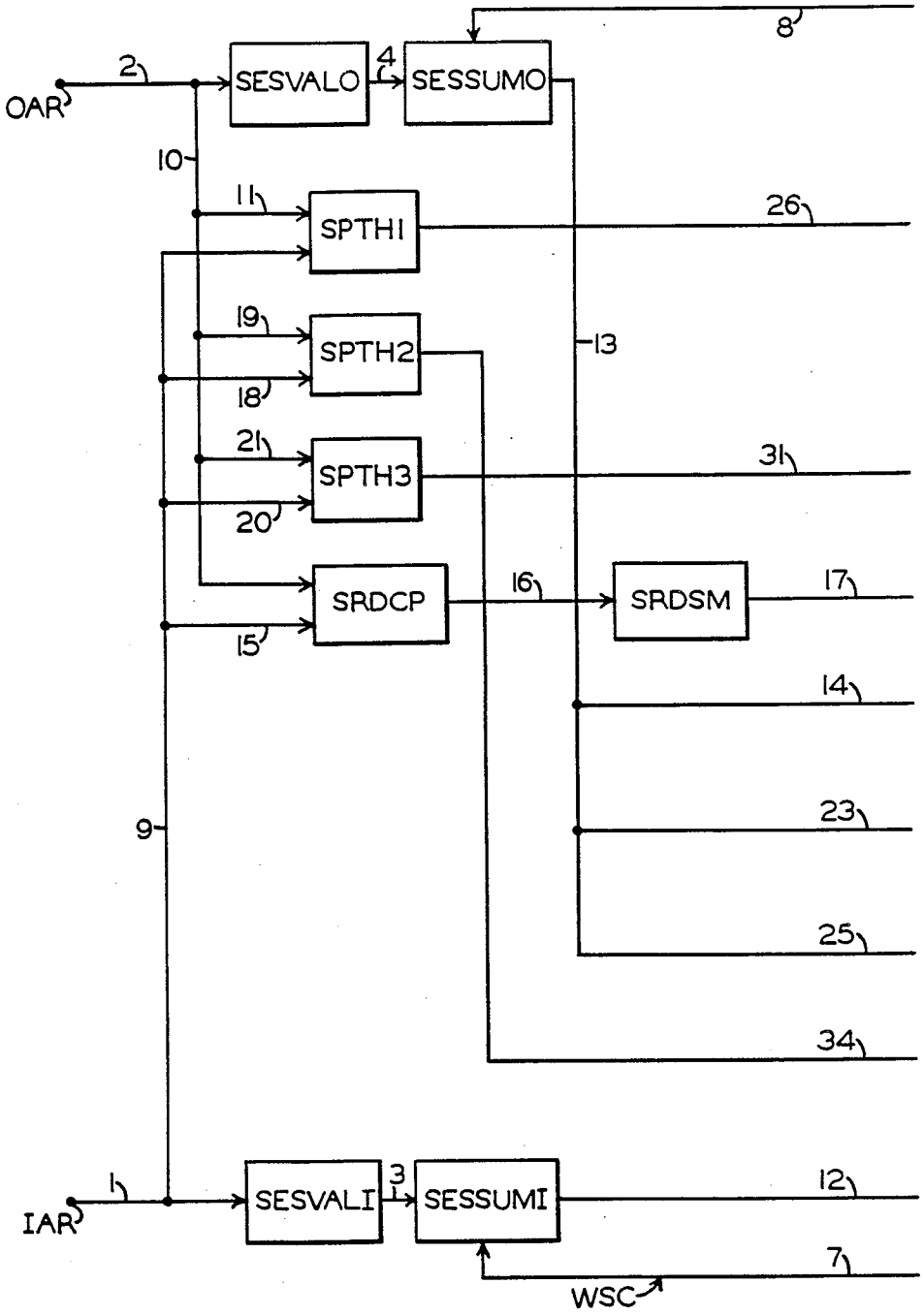
FIGS. 1A and 1B illustrate a schematic block diagram, which when placed in side-by-side relationship, namely, when
Figure 1B:
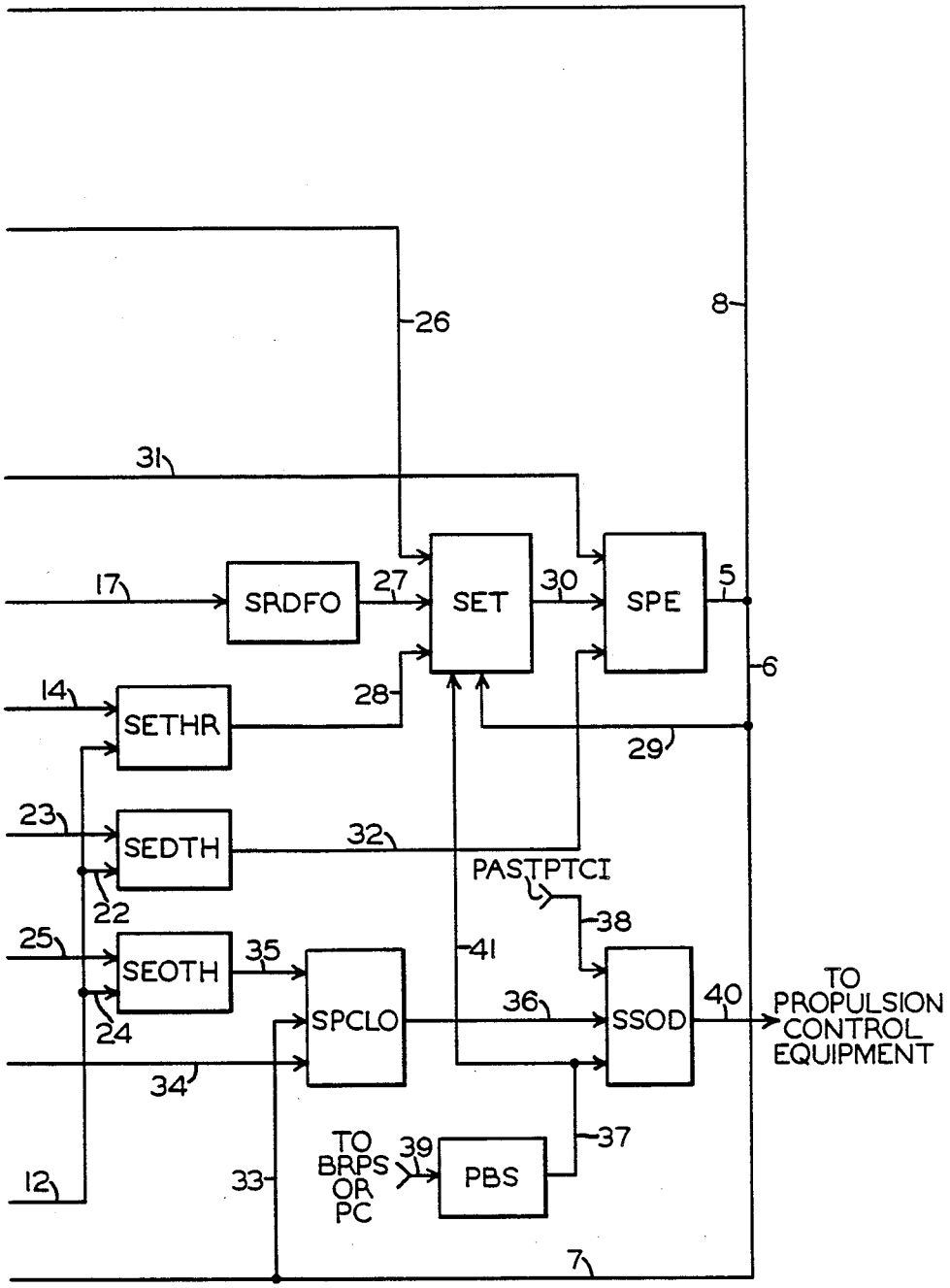

Referring now to the drawings, and in particular to FIGS. 1A and 1B, there is shown a wheel spin control arrangement generally characterized by WSC. It will be appreciated the present wheel spin control system does not depend on wheel size calibration or normalization to operate properly. Further, the present system allows the spinning wheel-axle set to be maintained at a selective level of spin which ensures optimum available adhesion for acceleration purposes. It will be understood that the procedure may be used for either two state or three state spin control operation and may be used on a per car or per truck propulsion control arrangement.

In practice, the railway vehicle may include a pair of trucks, each having an inboard and outboard wheel-axle set. As shown in FIG. 1A, a pair of terminals IAR and OAR receive axle rate signals which are produced by one and the other axle of one truck of the railway vehicle. The rate signals may be produced in a manner similar to that shown and disclosed in our U.S. Pat. No. 4,491,920, issued on Jan. 1, 1985, entitled "Rate Polarity Shift Wheel-Slip Control System", which is assigned to the assignee of this invention and which is incorporated by reference to the present application. It will be appreciated that the primary data used to form the following logic inputs is derived from the axle rate signals. Each of the following logic inputs are formed for each individual truck on the railway vehicle except where stated otherwise.

The inboard rate signals on terminal IAR are conveyed to the input of a spin energy storage value logic sensor SESVALI via lead while the outboard rate signals on terminal OAR are fed to the input of a spin energy storage value logic sensor SESVALO via lead 2. Each of the logic sensors SESVALI and SESVALO is directly responsive to each of the respective axle rate and produce a hexadecimal number on the respective output leads 3 and 4 as indicated in the following table:

| IAR, OAR AXLE RATE | SESVALI, SESVALO |
|---|---|
| > 13 mphps | 04 H |
| 13 to 10 mphps | 03 H |
| 10 to 7 mphps | 02 H |
| 7 to 4.6 mphps | 01 H |
| 4.6 to −1 mphps | 01 H |
| −1 to −4 mphps | 02 H |
| −4 to −7 mphps | 03 H |
| −7 to −10 mphps | 04 H |
| −10 < mphps | 05 H |

The letter H has no logical significance, but simply denotes a hexadecimal number. Thus, the hexadecimal number is formed on output leads 3 and 4 for each of the two axles for each truck of the vehicle and is conveyed to the respective inputs of a pair of spin energy storage sum sensors SESSUMI and SESSUMO. Another input to sum sensor SESSUMI is conveyed from spin enable circuit SPE via leads 5, 6 and 7 while another input to sum sensor SESSUMO is conveyed from spin enable circuit SPE via leads 5 and 8. If the axle rate on leads 3 or 4 becomes greater than or equal to 4.6 miles per hour per second (mphps), the inputs from the sensors SESVALI and SESVALO will be summed and stored in the memory of sensors SESSUMI and SESSUMO. Now if the axle rate on leads 3 or 4 is less than 3 mphps and if the input from spin enable sensor SPE is a logical "0", the memory of each sensor SESSUMI and SESSUMO will reset to OOH. Conversely, if the axle rate on leads 3 and 4 is less than 4.6 mphps and if the input spin enable sensor SPE is a logical "1", the input from respective spin energy storage value logic sensor SESVALI and SESVALO will be subtracted from the memory in sensors SESSUMI and SESSUMO.

It will be noted that the rate signals on lead 1 are also conveyed to the one input of a two input first spin threshold logic gate SPTH1 via lead 9 while the rate signals on lead 2 are also conveyed to the other input of the spin threshold logic gate SPTH1 via leads 10 and 11. If the inboard axle rate or the outboard axle rate is greater than or equal to 16 mphps, the output of the logic gate SPTH1 will be a logical "1", and if the axle rate of both inputs is less than 16 mphps the output will be a logical "0". That is, the following is a list of the two logical output conditions:

| IAR AXLE RATE | OAR AXLE RATE | SPTH1 |
|---|---|---|
| ≧16 mphps | ≧16 mphps | "1" |
| <16 mphps | ≧16 mphps | "1" |
| ≧16 mphps | <16 mphps | "1" |
| <16 mphps | <16 mphps | "0" |

As shown in Figs. 1A and 1B, the output of the inboard spin energy storage sum sensor SESSUMI is connected to one input of a two input spin energy threshold logic gate SETHR via lead 12 while the output of the outboard spin energy storage sum sensor SESSUMO is connected to the other input of the two input spin energy threshold logic gate SETHR via leads 13 and 14. If the hexadecimal output of either the inboard sum sensor SESSUMI or the outboard sum sensor SESSUMO is greater than or equal to 20H the output of the logic gate SETHR will be a logical "1", and if both are less than 20H the output will be a logical "0". The following is a list of the two logical conditions:

| SESSUMI | SESSUMO | SETHR |
|---|---|---|
| ≧20 H | ≧20 H | "1" |
| ≧20 H | <20 H | "1" |
| <20 H | ≧20 H | "1" |
| <20 H | <20 H | "0" |

It will be seen that a two input spin rate difference comparison circuit SRDCP compares the axle rate appearing on terminals IAR and OAR on the truck. As shown in FIG. 1A, the axle rate input terminal IAR is connected to one of the inputs of the comparator circuit SRDCP via leads 1, 9 and 15 and the axle rate input terminal OAR is connected to the other input of comparator circuit SRDCP via leads 2 and 10. The comparison is made by the subtraction of the axle rate signal appearing on terminal OAR from the axle rate signal appearing on terminal IAR, namely, (IAR-OAR). Now if the rate difference (IAR-OAR) is greater than 3 mphps and the signal value on terminal OAR is greater the 0 mphps, the output of the comparator circuit SRDCP is a logical "1", and if not the output of the comparator circuit SRDCP will be a logical "0".

Further as shown in Fig 1A, the output of comparator SRDCP is connected to the input of a spin rate difference sum sensor SRDSM via lead 16. The output of the sensor SRDSM is equal to the sum of a five (5) stages S1+S2+S3+S4+S5 placed in a serial register. The immediate input from comparator SRDCP is placed in stage S1, and the former input of stage S1 is shifted to stage S2. The former input to stage S2 is shifted to stage S3 while the former input to stage S3 is placed in stage S4. The former input to stage S4 is placed in stage S5. Finally, the former input of stage S5 is removed and discarded. The summing sensor SRDSM is operated on a 20 millisecond (MS) program time cycle for sensing the output of the comparator SRDCF.

In viewing FIG. 1B, it will be noted that the output of the summing sensor SRDSM is connected to the spin rate difference final output sensor SRDFO via lead 17. If the input to the output sensor SRDFO is equal to five (5) its output will be a logical "1"and if it is not equal to five (5) the output will be a logical "0".

As shown in FIG. 1A, the axle rate signals appearing on terminals IAR and OAR are applied to a second two input spin threshold logic gate SPTH2 via leads 9 and 18, and 10 and 19, respectively. If the inboard axle rate or the outboard axle rate is less than or equal to 1 mphps, the output of the sensing gate SPTH2 will be a logical "1" and if it is not the output will be a logical "0". The following is a list of the two logical output conditions:

| IAR AXLE RATE | OAR AXLE RATE | SPTH2 |
|---|---|---|
| ≦1 mphps | ≦1 mphps | "1" |
| ≦1 mphps | >1 mphps | "1" |
| >1 mphps | ≦1 mphps | "1" |
| >1 mphps | >1 mphps | "0" |

Further, in viewing FIG. 1A, it will be seen that a third two input spin threshold logic gate SPTH3 receives axle rate signals from terminals IAR and OAR via leads 9 and 20, and 10 and 21, respectively. If the inboard axle rate or the outboard axle rate is less than or equal to −8 mphps, the output of the gate SPTH3 will be a logical "1" and if it is not, the output will be a logical "0". The following table lists the two logical conditions:

| IAR AXLE RATE | OAR AXLE RATE | SPTH3 |
|---|---|---|
| ≧ −8 mphps | ≧ −8 mphps | "1" |
| ≧ −8 mphps | < −8 mphps | "1" |
| < −8 mphps | ≧ −8 mphps | "1" |
| < −8 mphps | < −8 mphps | "0" |

Referring again to FIG. 1B, it will be observed that the output of the spin energy storage sum sensor SESSUMI is connected to one of the inputs of a two input spin energy dissipation threshold logic gate SEDTH via leads 12 and 22 while the output of the spin energy storage sum sensor SESSUMO is connected to the other of the two inputs of the spin energy dissipation threshold logic gate SEDTH via leads 13 and 23. If the rate of the inboard axle or the outboard axle is less than or equal to 1AH, the output of gate SEDTH is a logical "1", and if not, the output is a logical "0". The following table lists the two logical output conditions in response to the hexadecimal inputs:

| SESSUMI | SESSUMO | SEDTH |
|---|---|---|
| ≦1 AH | ≦1 AH | "1" |
| ≦1 AH | >1 AH | "1" |
| >1 AH | ≦1 AH | "1" |
| >1 AH | >1 AH | "0" |

Further, it will be noted that the output of the inboard spin energy storage sum sensor SESSUMI is connected to one input of the two input spin energy optimization threshold logic gate SEOTH via leads 12 and 24 while the other input of the logic gate SEOTH is connected to the output of the outboard spin energy storage sum sensor SESSUMO via leads 13 and 25. If the rate of the inboard axle or the outboard axle is less than or equal to 20H, the output of the gate SEOTH will be a logical "1" and if not the output is a logical "0". The following lists the input and output conditions:

| SESSUMI | SESSUMO | SEOTH |
|---|---|---|
| ≦20 H | ≦20 H | "1" |
| ≦20 H | >20 H | "1" |
| >20 H | ≦20 H | "1" |
| >20 H | >20 H | "0" |

As shown in Figs. 1A and 1B, a three input spin enable timer circuit or sensor SET receives a first input from the first spin threshold logic gate SPTH1 via lead 26, a second input from the spin rate difference final output sensor SRDFO via lead 27, a third input from the spin energy threshold logic gate SETHR via lead 28, a fourth input from the power brake signal circuit PBS via lead 41, and a fifth input from spin enable sensor SPE via leads 5, 6 and 29. If there is a transition or change from a logical "0" to a logical "1" from the inputs of gate SPTH1, gate SETHR or sensor SRDFO, and if sensor PBS is in a logical "1" state, then the output on lead 30 of the timer SET will become a logical "1" for one (1) second. If sensor PBS is a logical "0", the sensor SET will output which is a logical "0". At the end of one (1) second or if a transition from a logical "1" to a logical "0" from the input of the spin enable sensor SPE occurs, then the sensor SET will reset its timer and will produce a logical "0".

In viewing FIG. 1B, it will be seen that a three input spin enable sensor SPE receives a first input from the timer sensor SET via lead 30, a second input from the third spin threshold logic gate SPTH3 via lead 31 and a third input from spin energy dissipation threshold logic gate SEDTH via lead 32. The following table lists the logical inputs to sensor SPE and the resulting logical output developed on lead 5 of the sensor SPE:

| SET INPUT | SEDTH INPUT | SPTH 3 INPUT | SPE OUTPUT |
|---|---|---|---|
| 0 | 0 | 0 | 0 |
| 0 | 0 | 1 | 0 |
| 0 | 1 | 0 | 0 |
| 0 | 1 | 1 | 0 |
| 1 | 0 | 0 | 1 |
| 1 | 0 | 1 | 0 |
| 1 | 1 | 0 | 0 |
| 1 | 1 | 1 | 0 |

There are a number of spin control possibilities which will determine the optimum propulsion force modulation output for each truck. The following is a letter abbreviation and a descriptive definition of the three propulsion force modulation output selection possibilities for spin control.

| |
|---|
| "FRP" ------ Full Requested Power |
| "ROP" ------ Removal of Power |
| "HPP" ------ Hold Present Power Level |

The three input spin control logic output circuit SPCLO has one input connected to the spin enable sensor SPE via leads 5, 6, 7 and 33, a second input connected to the second spin threshold logic gate SPTH2 via lead 34 and a third input connected to the spin energy optimization threshold logic gate SEOTH via lead 35. The following table sets forth the inputs of sensor SPE, gate SPTH2 and gate SEOTH applied to the spin control logic output circuit SPCLO which effectively produce the respective outputs on lead 36.

| SPE INPUT | SPTH 2 INPUT | SEOTH INPUT | SPCLO OUTPUT |
|---|---|---|---|
| 0 | 0 | 0 | FRP(F) |
| 0 | 0 | 1 | FRP |
| 0 | 1 | 0 | FRP(F) |
| 0 | 1 | 1 | FRP |
| 1 | 0 | 0 | ROP |
| 1 | 0 | 1 | HPP |
| 1 | 1 | 0 | HPP |
| 1 | 1 | 1 | HPP |

The parenthesized sixth letter of the English alphabet (F) denotes a physically impossible logical condition, and therefore it is considered as a logical processing failure. It will be appreciated that the present system is designed for a three (3) state propulsion force modulation operation, however, in the event that the control logic is used on a vehicle which is unable to perform a hold present power level "HPP" function a removal of power "ROP" function will be substituted therefore so that a two (2) state propulsion force modulation can be readily accommodated.

As shown in FIG. 1B, a three input slip-spin output determination sensor SSOD receives a first input from the spin control logic output circuit SPCLO via lead 36, a second input from the power-brake signal circuit PBS and a third input lead 38 from the per axle sensing to per truck control interface circuit PASTPTCI.

The power-brake signal sensor PBS may be activated by a brake release pressure switch BRPS or by a signal derived from the propulsion controller PC via lead 39. The power-brake signal on lead 39 indicates whether the train is in a power traction mode or in a braking mode. If the train is in a power mode, the output of the sensor PBS is a logical "1", and if it is not, the output will be a logical "0".

Turning now to the per truck sensing to per vehicle control interface PASTPTCI, it will be understood that this circuit functions and takes the output from the slip-spin determination sensor of each truck of the vehicle to make an ongoing determination of which of the outputs will be used in the communication logic for the vehicle propulsion control via lead 38. It will be appreciated that by employing a per truck propulsion control arrangement, the per truck sensing to per vehicle control interface is not necessary so that the output lead 40 of the slip-spin determination sensor SSOD of the given truck may be used directly for the communication logic. However, in the present system the outputs of the splip-spin output determination sensor SSOD of each truck are applied to the interface circuit and take the form of a propulsion force modulation state command instruction. The following table lists the command possibilities which are inputted from each truck of a vehicle via lead 40 and which are conveyed to the propulsion control equipment.

| PROPULSION STATE | DEFINITION | PRIORITY |
|---|---|---|
| "FTE" | Full Requested T.E. | 3 |
| "RTE" | Reduce T.E. to 0 | 1 |
| "HTE" | Hold Present T.E. Level | 2 |

The abbreviation T.E. stands for Tractive Effort.

It will be noted that the above-noted list also gives a priority number for each of the propulsion state command possibilities. The selected truck input to the interface will be the lowest numerical priority number of the truck which decides the force modulation output for the propulsion control, and if both trucks input the same priority number and are requesting the same force modulation output and the force modulation output will then be what both trucks are requesting.

The following examples illustrate two propulsion control systems.

Let us assume that in one example, that the railway vehicle is powered by split chopper propulsion control equipment. The equipment will perform per truck three (3) state spin control and per truck three (3) slip control in both blended and friction braking. The three state force modulation signals received from the controller is conveyed to the chopper control on each truck to control the force modulation in both the electric brake and power traction modes. The following is a table listing the inputs on leads 36, 37 and 38 versus the output on lead 40 of the slip-spin output determination sensor SSOD.

| | PBS INPUT | SPCLO INPUT | SLIP INTERFACE INPUT | SSOD OUTPUT |
|---|---|---|---|---|
| Brake Mode | 0 | IGN | APP | Full Requested T.E. |
| | 0 | IGN | REL | Reduce T.E. to 0 |
| | 0 | IGN | LAP | Hold T.E. |
| POWER MODE | 1 | FRP | IGN | Full Requested T.E. |
| | 1 | ROP | IGN | Reduce T.E. to 0 |
| | 1 | HPP | IGN | Hold T.E. |

Again, the letters T.E. represent the Tractive Effort during brake or power operations. The letters IGN on the inputs of SPCLO are ignored under these given conditions.

In another example in which the railway vehicle is provided with a cam propulsion control, the control equipment will perform per car two (2) state slip control and per truck three (3) state slip control in friction braking and if a slip occurs in electric braking, the electric brake will be knocked off or deactivated and the friction brake will be utilized until the sliding has been corrected for one (1) second. The two (2) state force modulation signals received from the controller will be fed to the propulsion control on the railway vehicle to control the force modulation in both the electric brake and the power traction modes of operation. The following is a table listing inputs on leads 36, 37 and 38 versus the output on lead 40 of the slip-spin output determination sensor SSOD.

| PBS INPUT | SPCLO INPUT | SLIP INTERFACE INPUT | SSOD OUTPUT |
|---|---|---|---|
| 0 | IGN | APP | Full Requested T.E. |
| 0 | IGN | REL | Reduce T.E. to 0 |
| 0 | IGN | LAP | Reduce T.E. to 0 |
| 1 | FRP | IGN | Full Requested T.E. |
| 1 | ROP | IGN | Reduce T.E. to 0 |

It will be understood that various alterations and changes may be made by those skilled in the art without departing from the spirit and scope of the subject invention. Further, with the increased usage of microprocessors and minicomputers, it is evident that the various functions and operations may be carried out and processed by a suitably programmed computer which receives the different inputs and produces the appropriate outputs. Therefore, it will be appreciated that certain modifications, ramifications, and equivalents will be readily apparent to persons skilled in the art, and accordingly, it is understood that the present invention should not be limited to the exact embodiment shown and described, but should be accorded the full scope and protection of the appended claims.

We claim:

1. An energy storage wheel spin propulsion control system for a vehicle comprising, spin energy storage value means responsive to an axle rate signal of each axle for producing a logical output signal, spin energy storage sum means for causing a summing, subtracting and resetting of the logical output signals produced by the spin energy storage value means, first spin threshold means for producing a first logic signal when the axle rate signal of either one of the axles is $\geqq$ a first predetermined axle rate, spin energy threshold means for producing a first logic signal when one of the logical output signals of said spin energy storage sum means is $\geqq$ a first logical output signal, spin rate difference comparison means for comparing the axle rate signal of each axle so that if the axle rate signal of each of the axles is greater than a second predetermined axle rate and the axle rate signal of one of the axles is greater than a third predetermined axle rate a first logic signal is produced and if not a second logic signal is produced, spin rate difference sum means for summing the first logic signal and the second logic signal of said spin rate difference comparison means, spin rate difference final output means for producing a first logic signal if the total of the first logic signals of said spin rate difference sum means is equal to a given value, second spin threshold means for producing a first logic signal when the axle rate signal of either one of the axles is $\leqq$ a fourth predetermined axle rate, third spin threshold means for producing a first logic signal when the axle rate signal of either one of the axles is $\leqq$ a fifth predetermined axle rate, spin energy dissipation threshold means for producing a first logic signal when one of the logical output signals of said spin energy storage sum means is $\leqq$ a second logical output signal, spin energy optimization threshold means for producing a first logic signal when one of the logical output signals of said spin energy storage sum means is $\leqq$ a third logical output signal, spin enable timer means responsive to a transition from a second logic signal to a first logic signal, said first spin threshold means, said spin energy threshold means and said spin rate difference final output means for producing a first logic signal for a given time period and for producing a second logic signal upon expiration of the given time period and when a spin enable means undergoes a transition from a first logic signal to a second logic signal, said spin enable means receiving said first logic signal and said second logic signal from said spin enable timer means, said spin energy dissipation threshold means and said third spin threshold means for producing a first logic signal and a second logic signal, spin control logic output means responsive to said first logic signal and to said second logic signal received from said spin enable means, said second spin threshold means and said spin energy optimization threshold means for producing one of three spin control output signals, and slip-spin output determination means for receiving an input from each of the power-brake signal means, slip interface means and said spin control logic output means for producing either a full, a reduce or a hold tractive effort output command signal.

2. The energy storage wheel spin propulsion control system as defined in claim 1, wherein said first predetermined axle rate is 16 mile per hour per second.

3. The energy storage wheel spin propulsion control system as defined in claim 1, wherein said first logical output signal is a hexadecimal number.

4. The energy storage wheel spin propulsion control system as defined in claim 3, wherein said hexadecimal number is 20.

5. The energy storage wheel spin propulsion control system as defined in claim wherein said fourth predetermined axle rate is 1 mile per hour per second.

6. The energy storage wheel spin propulsion control system as defined in claim 1, wherein said fifth predetermined axle rate is −8 miles per hour per second.

7. The energy storage wheel spin propulsion control system as defined in claim 1, wherein said second logical output signal is a hexadecimal number.

8. The energy storage wheel spin propulsion control system as defined in claim 7, wherein said hexadecimal number is IA.

9. The energy storage wheel spin propulsion control system as defined in claim 1, wherein said third logical output signal is a hexadecimal number.

10. The energy storage wheel spin propulsion control system as defined in claim 9, wherein said hexadecimal number is 20.

11. The energy storage wheel spin propulsion control system as defined in claim 1, wherein said spin rate difference sum means is a five stage register.

12. The energy storage wheel spin propulsion control system as defined in claim 11, wherein said first and second logic signals of said spin rate difference comparison means are serially fed into said five stage register.

13. The energy storage wheel spin propulsion control system as defined in claim 1, wherein said second predetermined axle rate is 3 miles per hour per second.

14. The energy storage wheel spin propulsion control system as defined in claim 1, wherein said third predetermined axle rate is 0 miles per hour per second.

15. The energy storage wheel spin propulsion control system as defined in claim 1, wherein said first logic signal is a binary "1" and said second logic signal is a binary "0".

* * * * *